United States Patent [19]

McMorrow

[11] 4,176,451

[45] Dec. 4, 1979

[54] BLOOD SEGMENT PROCESSOR

[76] Inventor: John J. McMorrow, 55 Florence Ave., Oyster Bay, N.Y. 11771

[21] Appl. No.: 942,415

[22] Filed: Sep. 14, 1978

[51] Int. Cl.[2] ..... B26B 17/00

[52] U.S. Cl. ..... 30/124; 128/768; 422/99

[58] Field of Search ..... 30/124, 123; 128/2 F, 128/2 G, DIG. 5; 422/99

[56] References Cited

U.S. PATENT DOCUMENTS

| | | | |
|---|---|---|---|
| 3,200,813 | 8/1965 | Cristakis | 128/2 F |
| 3,799,400 | 3/1974 | Fleury | 30/123 |
| 4,000,561 | 1/1977 | Wieder et al. | 30/124 |

*Primary Examiner*—Jimmy C. Peters

*Attorney, Agent, or Firm*—James P. Malone

[57] ABSTRACT

Blood segment processor for releasing blood from a segmented plastic tube into a test tube. A tubular member is adapted to fit inside a test tube. A cutter is mounted in the tubular member so that a segmented plastic tube containing blood may be inserted in the tubular member and cut, to thereby release the blood into the test tube.

1 Claim, 3 Drawing Figures

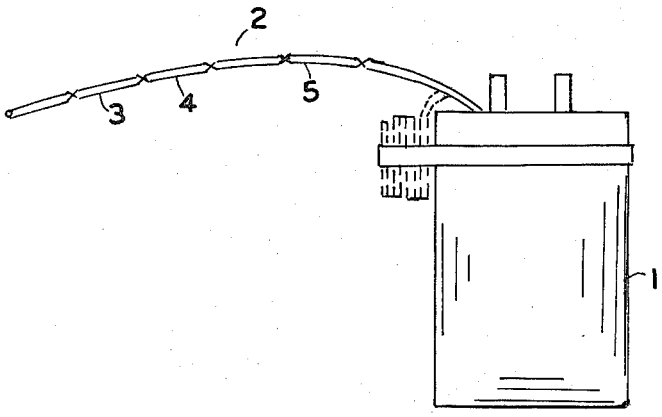
FIG 1
FIG 2
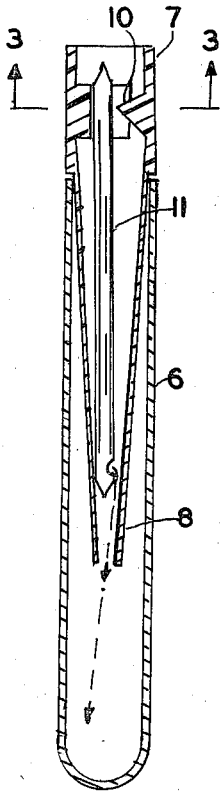
FIG 3
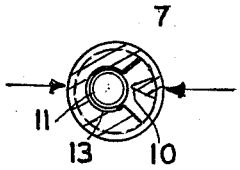

BLOOD SEGMENT PROCESSOR

This invention relates to blood processing means and more particularly to means for processing segmented plastic tubes containing blood.

Blood is drawn from a patient through a plastic tube into a storage bag, the tube being attached to the bag. The tube is then cut off about eight or ten inches from the bag and sealed along its length into several segments. The segmented tube is then folded up and taped or otherwise affixed to the side of the bag. The purpose of this is that when it is desired to make a blood test, for instance, for determining the type of blood, one of the tubular segments can be cut off and the blood contained in that segment used for the test without opening the sealed bag.

The conventional method for cutting off the segment and releasing the blood into a test tube is with the use of scissors. The segment is cut at each end with the scissors and drained into a test tube. This is a generally sloppy operation and results in blood being spilled and the scissor having to be cleaned and sterilized.

The present invention provides means for blood testing and provides a disposable tubular member which is attached to fit inside the test tube. The tubular member has a cutter or sharp spur mounted in its mouth. The segment is inserted into the tubular member and pierced by the cutter at each end so that the blood will drain off into the test tube. The tubular member containing the cutting spur may then be disposed of. This arrangement provides a neat operation and eliminates the use and cleaning of scissors and work benches.

Accordingly, a principal object of the invention is to provide new and improved means for blood processing.

Another object of the invention is to provide new and improved means for processing tubular segments containing blood.

Another object of the invention is to provide new and improved means to release blood from a segmented plastic tube into a test tube comprising; a tubular member adapted to fit inside a test tube, and a cutter mounted in said tubular member whereby a segmented plastic tube containing blood may be inserted in said tubular member and cut to thereby release the blood into said test tube.

These and other objects of the invention will be apparent from the following specification and drawings of which:

FIG. 1 is a side view of a typical blood storage bag.

FIG. 2 is a side sectional view of an embodiment of the invention mounted in a test tube, enlarged.

FIG. 3 is a sectional view taken along the line 3—3 of FIG. 2.

Referring to the drawings, FIG. 1 shows a typical blood storage bag 1, which is generally of plastic, having a tubular plastic member 2, connected thereto. The blood is drawn from the donor through the tube 2. When the blood draining is completed there is some blood left in the tube 2, which is then heat sealed at the end and also heat sealed into segments 3, 4 and 5. The tubular member 2, is then folded up as shown by the dotted lines and taped or otherwise affixed to the bag.

When it is desired to perform a blood typing test on the blood, one of the segments 3 is cut off and its blood content drained into a test tube.

The present invention provides a sanitary means for cutting the segment off and cutting the segment on each end so that the blood will drain into the test tube 6. The processor of the present invention comprises a generally tubular member 7, with a tapering lower end 8. The upper end of the tubular member contains a cutter 10 which may be a sharp spur. In the inner wall of the tubular member opposite the spur is built up and shaped to position the tubular segment 11. The built up inner wall has a cylindrical socket portion 13 which receives the tubular segment 11.

The tubular member 7 is preferably of a flexible plastic so that when the segment is inserted into the socket 13, the tube may be squeezed between the fingers of the user as shown by the arrows so that the spur 10 will pierce the segment 11. In order to drain the blood out of the tubular segment, it is first necessary to pierce the lower end of the segment of the spur and drop the segment down into the tubular member 7, and then pierce the upper end of the segment with the spur. The blood will then be able to drain out the bottom of the segment into the test tube. The tapering lower end of the tubular member 7, is dimensioned so that it will retain the segment. Therefore, after the blood drains out of the segment, the tubular member 7, is withdrawn from the test tube together with the empty segment and thrown away.

The tubular member 7 may be made of a single molded piece including the spur, of flexible plastic so that there is sufficient flexibility to perform the cutting or piercing of the segments.

It is claimed:

1. Means to release blood from a segmented plastic tube into a test tube comprising:

a flexible tubular member adapted to fit inside a test tube, and a spur cutter mounted a predetermined distance from the top in said tubular member, whereby a segmented plastic tube containing blood may be inserted in said tubular member and pierced by the spur cutter to punch a hole thereby release the blood into said test tube, without any spillage, the interior wall of the tubular member being shaped to position the segmented tube so that it is pierced by the spur at a central point on the tubular member.

* * * * *